US009957022B2

(12) United States Patent
Cabrinha et al.

(10) Patent No.: US 9,957,022 B2
(45) Date of Patent: May 1, 2018

(54) COUPLING DEVICE FOR A SPORTS HARNESS AND SPORTS HARNESS

(71) Applicant: Neil Pryde Limited, New Territories, Hong Kong (CN)

(72) Inventors: Pete Cabrinha, Hong Kong (CN); David Starbuck, Hong Kong (CN); Philip Sobolev, Hong Kong (CN); David Hastilow, Hong Kong (CN)

(73) Assignee: Neil Pryde Limited, Hong Kong (CN)

( * ) Notice: Subject to any disclaimer, the term of this patent is extended or adjusted under 35 U.S.C. 154(b) by 210 days.

(21) Appl. No.: 14/559,179

(22) Filed: Dec. 3, 2014

(65) Prior Publication Data

US 2016/0159444 A1 Jun. 9, 2016

(51) Int. Cl.
*B63B 35/79* (2006.01)
*B63H 9/10* (2006.01)

(52) U.S. Cl.
CPC ..... *B63B 35/7993* (2013.01); *B63B 35/7976* (2013.01); *B63B 35/7979* (2013.01); *B63H 9/1007* (2013.01)

(58) Field of Classification Search
CPC ..... B63B 35/7993; B63B 35/7979; B63B 35/7996; B63H 9/1007; B63H 9/1014
See application file for complete search history.

(56) References Cited

U.S. PATENT DOCUMENTS 2,273,209 A * 2/1942 Louthan ..... A01K 91/08 43/43.13
4,452,161 A * 6/1984 McCoy ..... B63B 35/7993 114/39.18
4,934,297 A * 6/1990 Long ..... B63B 35/7993 114/39.16
D321,234 S * 10/1991 Fildan ..... D21/771
5,150,901 A * 9/1992 Stawicki ..... A63B 69/365 473/215
6,293,215 B1 * 9/2001 Moorrees ..... B63B 35/7993 114/39.18
6,508,186 B2 * 1/2003 Veh ..... A44B 11/125 114/39.18

(Continued)

FOREIGN PATENT DOCUMENTS

DE 10302015 A1 * 8/2004 ..... B63B 35/7993
DE 102014113969 A1 * 2/2016 ..... B63H 9/1007

(Continued)

*Primary Examiner* — Benjamin P Lee
(74) *Attorney, Agent, or Firm* — Leydig Voit and Mayer

(57) ABSTRACT

A hookless coupling device for releasable connection to a sports harness includes an elongate body having a connector end for connection with the sports harness, an engagement end, and an elongate aperture extending between the connector end and the engagement end for engaging an engager. The aperture is wider at the connector end than at the engagement end. The sports harness includes a band for surrounding the waist or hips of a person, and the elongate body. A sports device, releasably engagable to the harness, has a spherical engager tethered with a line. The aperture passes the spherical engager though the engagement end and the engager is moved to the connector end. A sports kite includes a canopy, a traction line having a first end tethered to the canopy, and a second end to which the spherical engager is connected.

9 Claims, 10 Drawing Sheets

(56) References Cited

U.S. PATENT DOCUMENTS

| | | | | |
|---|---|---|---|---|
| 7,992,506 | B1 * | 8/2011 | Patton | B63B 35/7979 114/39.18 |
| 2004/0065780 | A1 * | 4/2004 | Bellacera | B63B 35/7979 244/155 A |
| 2006/0046589 | A1 * | 3/2006 | Farley | B63B 35/79 441/108 |
| 2009/0159752 | A1 * | 6/2009 | Maldonado | B63B 35/7979 244/155 A |
| 2016/0159443 | A1 * | 6/2016 | Cabrinha | B63B 35/7976 114/39.18 |
| 2016/0221649 | A1 * | 8/2016 | Harrington | B63B 35/7993 |

FOREIGN PATENT DOCUMENTS

| | | | | |
|---|---|---|---|---|
| WO | WO 2012056060 | A1 * | 5/2012 | B62B 1/12 |
| WO | WO 2013111169 | A1 * | 8/2013 | B63B 35/7993 |
| WO | WO 2015031977 | A1 * | 3/2015 | B63B 35/7993 |

* cited by examiner

COUPLING DEVICE FOR A SPORTS HARNESS AND SPORTS HARNESS

FIELD OF THE INVENTION

The present invention relates to a coupling device for a sports harness. The invention also relates to a sports harness with engagement and engager means for releasably coupling a sports device to the harness.

BACKGROUND TO THE INVENTION

In wind driven sports such as kiteboarding, windsurfing and sailing a sportsperson wears a harness to which the sports device can be releasably coupled. The harness includes a spreader bar with a downwardly orientated hook. The sports device also includes a loop on a tether, or line, which can be engaged with the hook to releasably couple the sports device to the harness. The pull of the sports device on the hook and harness is generally in an upwards direction and outwards, for example in kiteboarding the kite is often maneuvered overhead of the rider. The hook must have a downward orientation in order to retain the loop. However, the upwards pull of the sports device can cause rotation of the spreader bar and front of the harness causing discomfort to the sportsperson.

Wind driven sports utilising a harness coupling arrangement are most frequently performed on water and involve a sports device having a number of lines. An additional disadvantage of the tradition hook and hoop coupling arrangement is the risk of lines unintentionally catching or tangling with the hook and posing a danger to the sportsperson.

It is an object of the present invention to overcome or at least ameliorate these disadvantages with traditional hook and loop coupling of wind drive sports devices.

SUMMARY OF THE INVENTION

One or move invention or inventions described herein are set forth in the accompanying claims.

In a first particular aspect of the invention there is provided a hookless coupling device for a sports harness, the coupling device comprising an elongate body having a connector end for connection with a sports harness and an engagement end, and an elongate aperture extending between the connector end and the engagement end, the aperture wider at the connector end for receiving an engager through the aperture and narrower at the engagement end for engaging the engager with the elongate body.

In a second particular aspect of the invention there is provided a method of releasably connecting a sports device with a harness, the sports device having a spherical engager tethered with a line, the method comprising providing an elongate aperture connected with a harness, the aperture being wider at a proximal end adjacent the harness and narrower at a distal end, and passing the spherical engager though the proximal end of the aperture and moving the spiral engager upwards to engage the distal end of the slot.

In a third particular aspect of the invention there is provided a band for surrounding a waist or hips of a person, a hookless elongate body extending upwardly and away from the band, and an elongate aperture in the body, the aperture having a harness end and an engagement end, the aperture wider at the harness end for receiving an engager through the aperture and narrower at the engagement end for engaging the engager with the elongate body.

In a fourth particular aspect of the invention there is provided a sports kite comprising a canopy, a traction line having a first end tethered with the canopy and a second end, a spherical engager connected to the second end of the traction line, and a hookless engagement body connectable with a harness, the hookless engagement body including an elongate aperture, the aperture having a harness end and an engagement end, the aperture wider at the harness end for receiving the engager through the aperture and narrower at the engagement end for engaging the engager.

Further inventions or aspects of the invention may become apparent from the following description which is given by way of example only.

BRIEF DESCRIPTION OF THE DRAWINGS

The invention will now be described with reference to the accompanying drawings in which.

DESCRIPTION OF THE PREFERRED EMBODIMENTS

The following description is given by way of example only to illustrate the invention and is not intended to limit the scope of use or functionality of the invention. In particular, the invention is not limited in its application to the details of construction and the arrangements of components set forth in the following description or illustrated in the accompanying drawings. The invention is capable of other embodiments and of being practiced or being carried out in various ways. Also, it is to be understood that the phraseology and terminology used is for the purpose of description and should not be regarded as limiting.

In the description and claims the term "hookless" means not having or utilising a hook as one element in a coupling means (i.e., a hook and loop as is currently known in wind driven sports such as kiteboarding, windsurfing and sailing). The terms "inwardly", "towards", "upwardly" and "away from", "outwardly", "up" and "down" are to be interpreted with reference to the in-use, in-situ or operational placement of a device, body or object in relation to a sportsperson using said device or body or object in a normal standing or operating posture.

Figure 1:
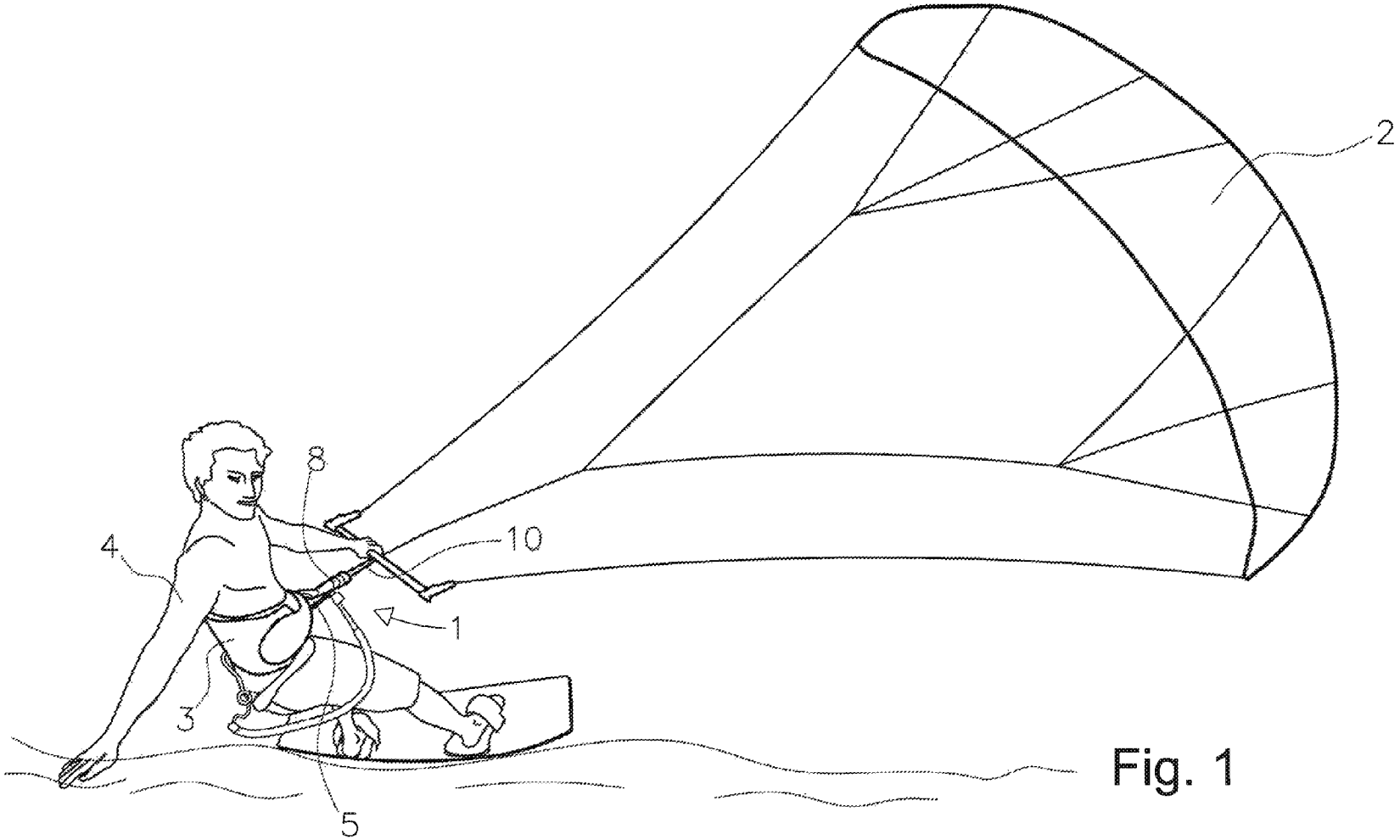
FIG. 1 illustrates a sports kite and rider set-up.

FIG. 1 illustrates a general kite surfing set-up in which a rider or kite surfer 4 riding a waters sports board utilises a large transition kite 2 to pull the rider and board across the surface of a body of water. The rider wears a harness 3 to which a traction line 10 of the kite can be releasably coupled. The invention provides a hookless coupling device for releasably securing the kite 2 to the rider's harness 3. In its broadest embodiment the hookless coupling device is an elongate body 5 that can be connected at one end 6, 11 to a sports harness 3 and has an opposite engagement end 7 to which the sports device 2 releasable couples by way of an engager 8 connected to the sports device traction line 10. The body 5 has an elongate aperture 9 that preferably extends substantially the length of the body 5 between the harness connector end 6 and the engagement end 7. The aperture is wider in breadth at the harness connector end 6 to allow the engager 8 to pass through the aperture 9. The aperture 9 narrows towards the engagement end 7 such that the engager 8 cannot pass though the aperture 9 at the engagement end 7. In use the elongate body 5 extends upwardly and away from the harness 3 and sportsperson 4 wearing the harness 3. The engager 8, which is tethered to the sports device 2 by the traction line 10 (or rope in non-nautical terms), is passed through the wider end 11 of the aperture 9 and moved towards the engagement end 7 where it cannot pass back though the aperture 9 and therefore engages with the engagement end 7 of the body 5 to couple the tethered sports device 2 to the body 5 and the harness 3. In the most preferred embodiment the engager 8 is a spherical shaped body, or ball, and the body 5 has a semi-circular or cup-shaped socket 12 at the engagement end 7 communicating with the aperture 9 so that when a spherical engager 8 is moved to the engagement end 7 it is received within the socket 12 to pivotally engage the body 5 and engager 8 in the manner of a ball and socket joint.

Figure 2:
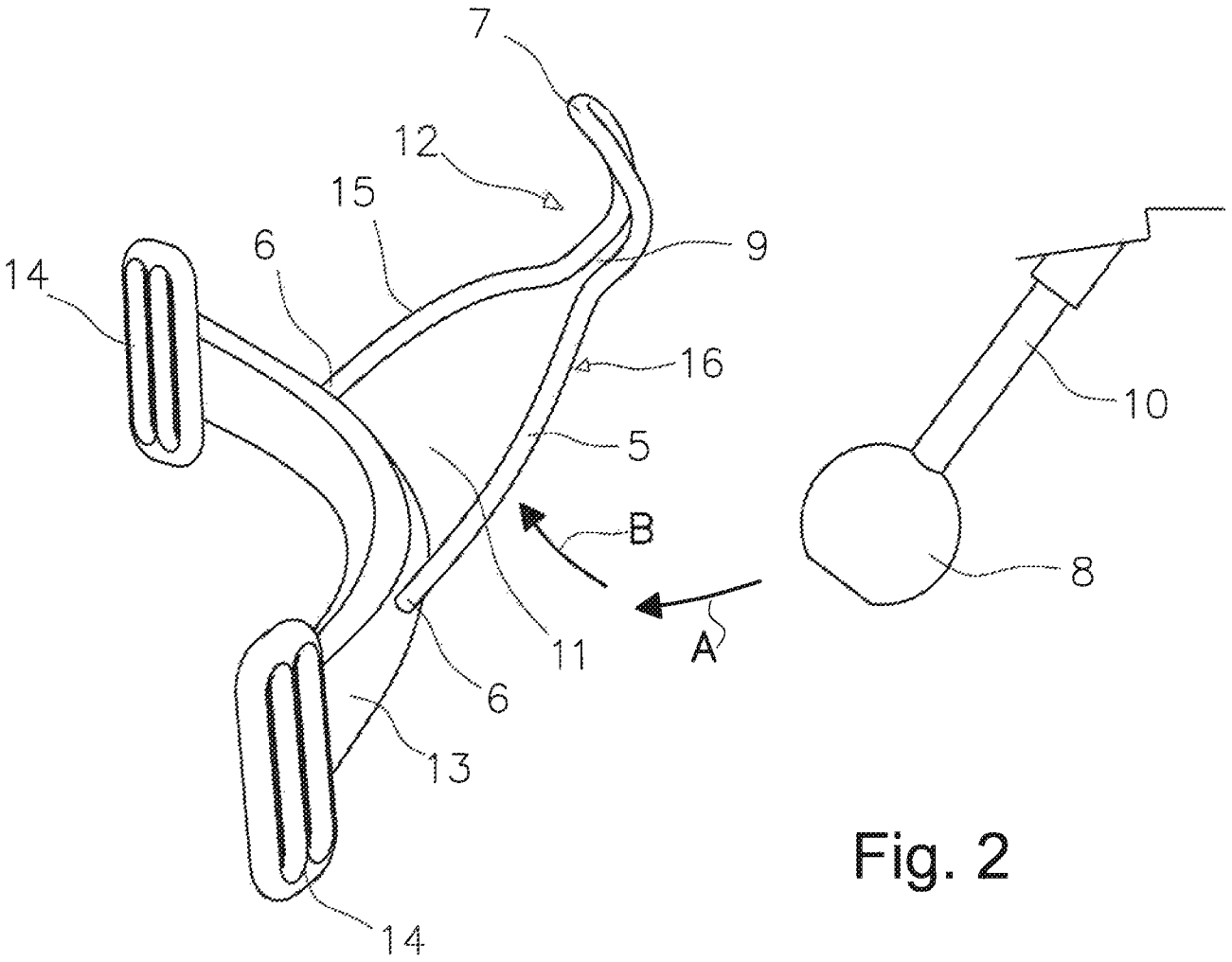
FIG. 2 illustrates a hookless spreader bar and coupling according to the invention.
Figure 4:
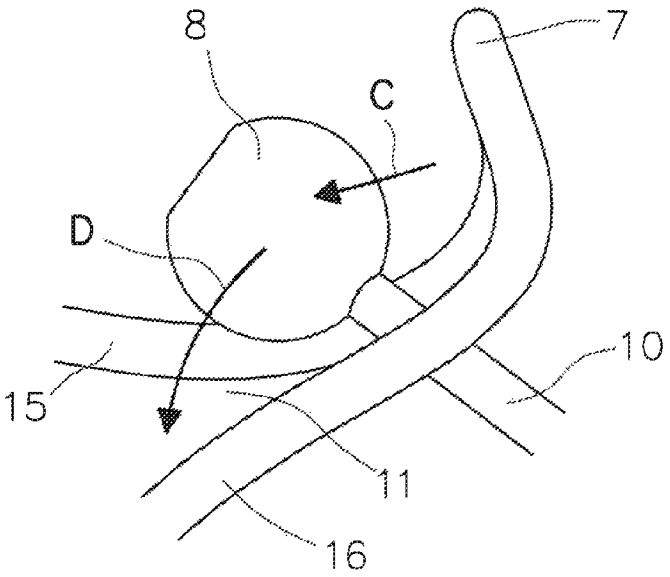
FIG. 4 illustrates the ball and socket of the hookless coupling.
Figure 3:
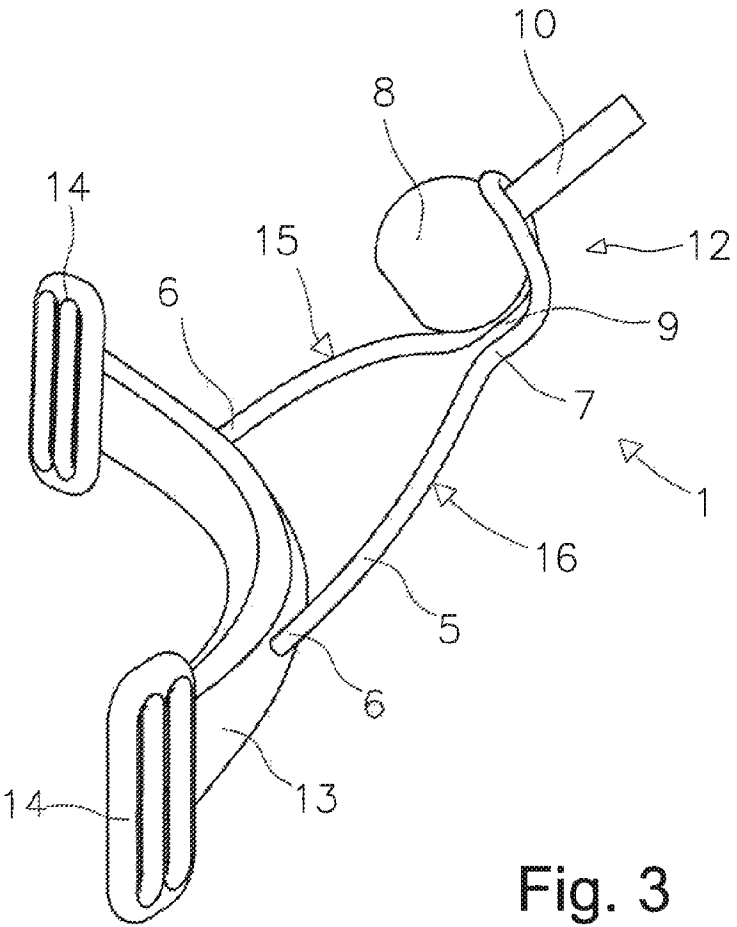
FIG. 3 illustrates the hookless spreader bar and coupling in a coupled arrangement.

FIGS. 2 and 3 illustrate how the engager 8 and hookless coupling device 5 are coupled and uncoupled. To couple the kite 2 the rider 3 moves the engager 8 tethered to the kite line 10 from a low position in an inwardly direction, as indicated by arrow A, and then upwardly in the direction, as indicated by arrow B, so that the engager 8 passes through the wider end 11 of the hookless coupling device slot. The engager once through wider end 11 of the slot is moved upwardly and away from the rider to secure it with the engagement end 7 of the hookless coupling device. Generally in normal use the pull direction of the tethered sports device 2 is upwardly and away from the sportsperson 3 operating the sports device 2. The pull of the sports device 2 is thus from the wider harness connector end 6 towards the engagement end 7 and assists in moving and holding the engager 8 into the engaged position at the engagement end 7 of the body 5. In order to uncouple the tethered sports device 2 from the riders harness the rider must move the engager 8 in the opposite direction of the pull, which is inwardly towards the rides body, as indicated by arrow C, and then downwardly, as indicated by arrow D, though the wider end 11 of the aperture 9.

In one embodiment the elongate body 5 is connected with the sports harness 3 by way of a spreader bar 13. The spreader bar 13 is affixed at the connector end 6 of the elongate body 5. The spreader bar 13 is orthogonal to the elongate body 5 which is affixed at the centre of the bar 13. At either end of the spreader bar 13 there are buckles or other means 14 for attaching the spreader bar 13 with straps of a sports harness 3 in known manner. In other embodiments the elongate body 5 is connected with the sports harness 3 by means other than a spreader bar. For example, in one alternative embodiment the elongate body 5 may have a buckle at its connector end 6 for attachment directly to a strap of the sports harness 3. It is preferable, although not essential, that the elongate body 5 be held in a position upwardly and away from the harness 3 when not engaged with the engager 8 of the sports device 2 so that the engager 8 may be easily engaged with the aperture 9 of the elongate body 5 quickly and with one hand. The spreader bar 13 maintains the elongate body 5 in this ready orientation. In an alternative embodiments using for example a buckle and strap to attach the elongate body 5 to the harness 3, a pocket or strap/flap on the harness or plastic fitting can be used to maintain the elongate body in an upwardly and outwardly orientation.

Figure 16:
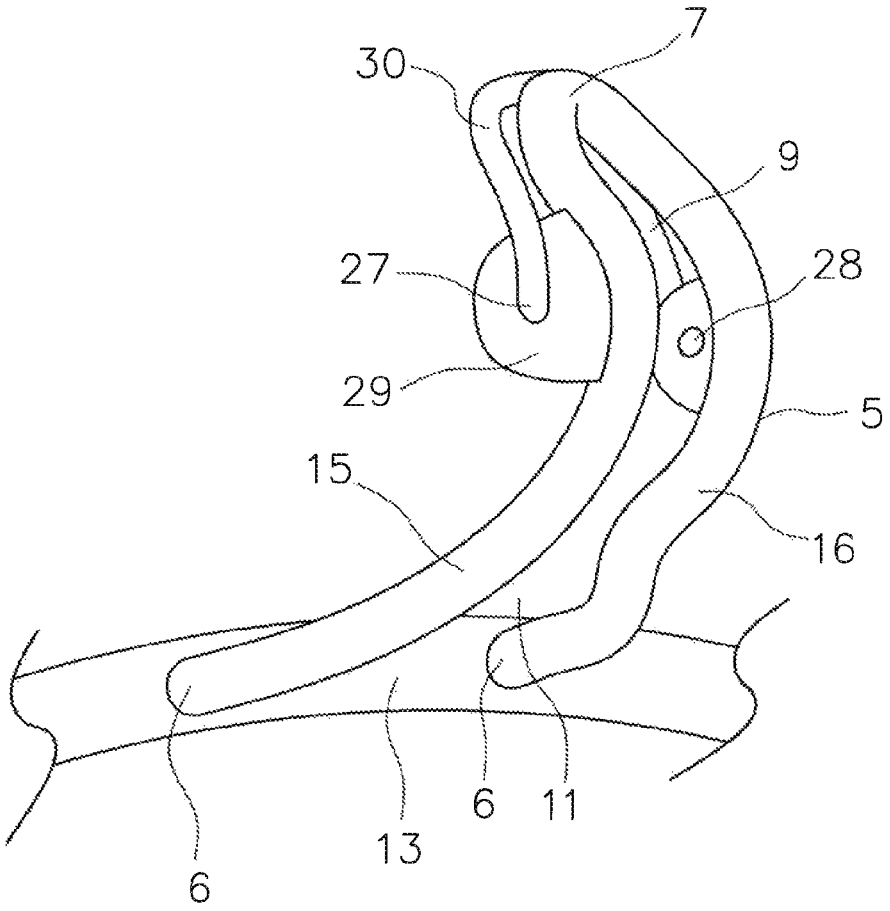
FIG. 16 illustrates the second hookless coupling socket and gate in an integrally fixed combination with a spreader bar.

In one embodiment, for example shown in FIGS. 2, 3 and 16, the elongate body 5 and aperture 9 are formed by a frame of stiff wire bent in a narrow inverted U-shape. The free tail ends 6 of the two legs 15, 16 of the U are affixed to the centre section of the spreader bar 13 by welding for example. The two legs 15, 16 form two sides of the frame defining opposite elongate edges of the aperture 9. The top of the U forms a curved end 7 joining the sides at the engagement end of the elongate body. The two legs 15, 16 forming two sides of the frame may not be parallel, but diverge towards the tail ends attached to the spreader bar to provide a wider slot 11 at the connector end 6 for the engager 8 to pass through. Alternatively, and perhaps preferably, the two legs 15, 16 forming two sides of the frame may have outwardly bent dog-legs to provide a wider slot 11 at the connector end 6 for the engager 8 to pass through. The curved end 7 of the U may also be bent slightly upwardly about an axis transverse to the slot 9, 11 at the engagement end 7 to form a semi-circular socket 12 for pivotally receiving a ball shaped engager 8.

Figure 5:
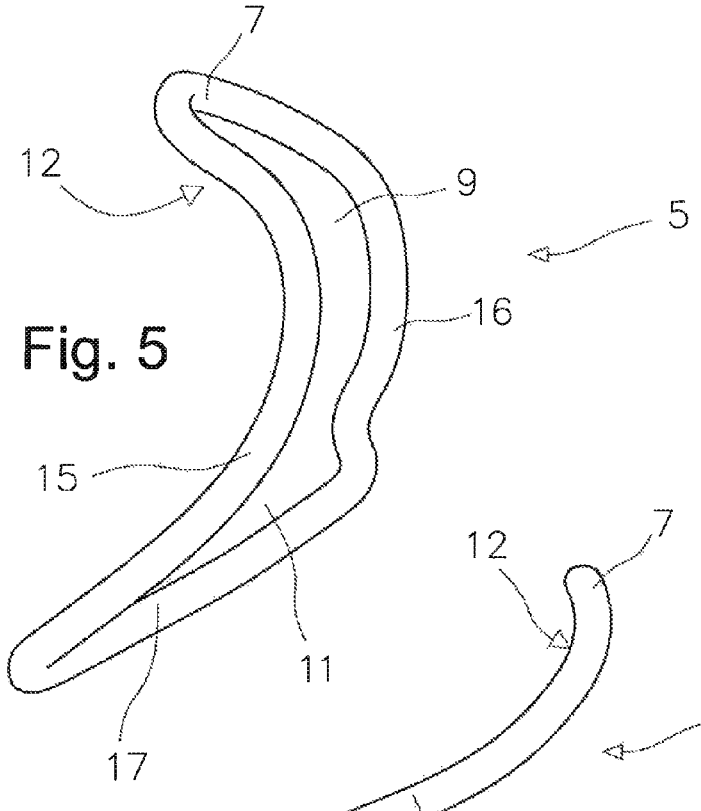
FIG. 5 is a perspective illustration of a hookless coupling socket according to the invention.
Figure 6:
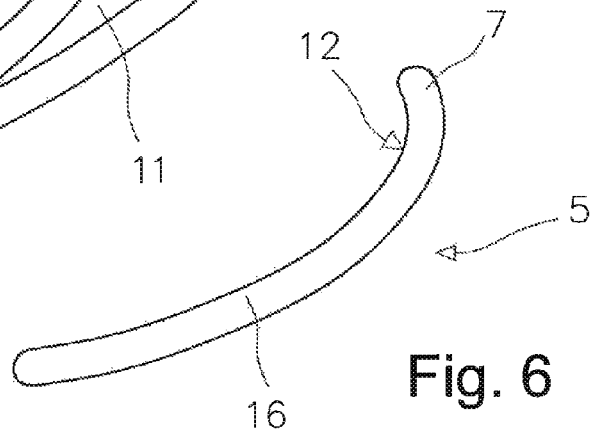
FIG. 6 is a side illustration of the hookless coupling socket of FIG. 5.
Figure 7:
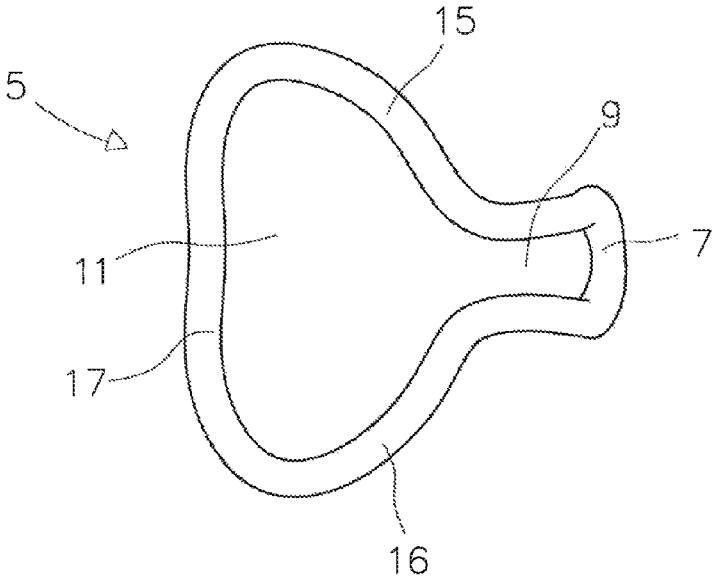
FIG. 7 is a bottom illustration of the hookless coupling socket of FIGS. 5 and 6.
Figure 8:
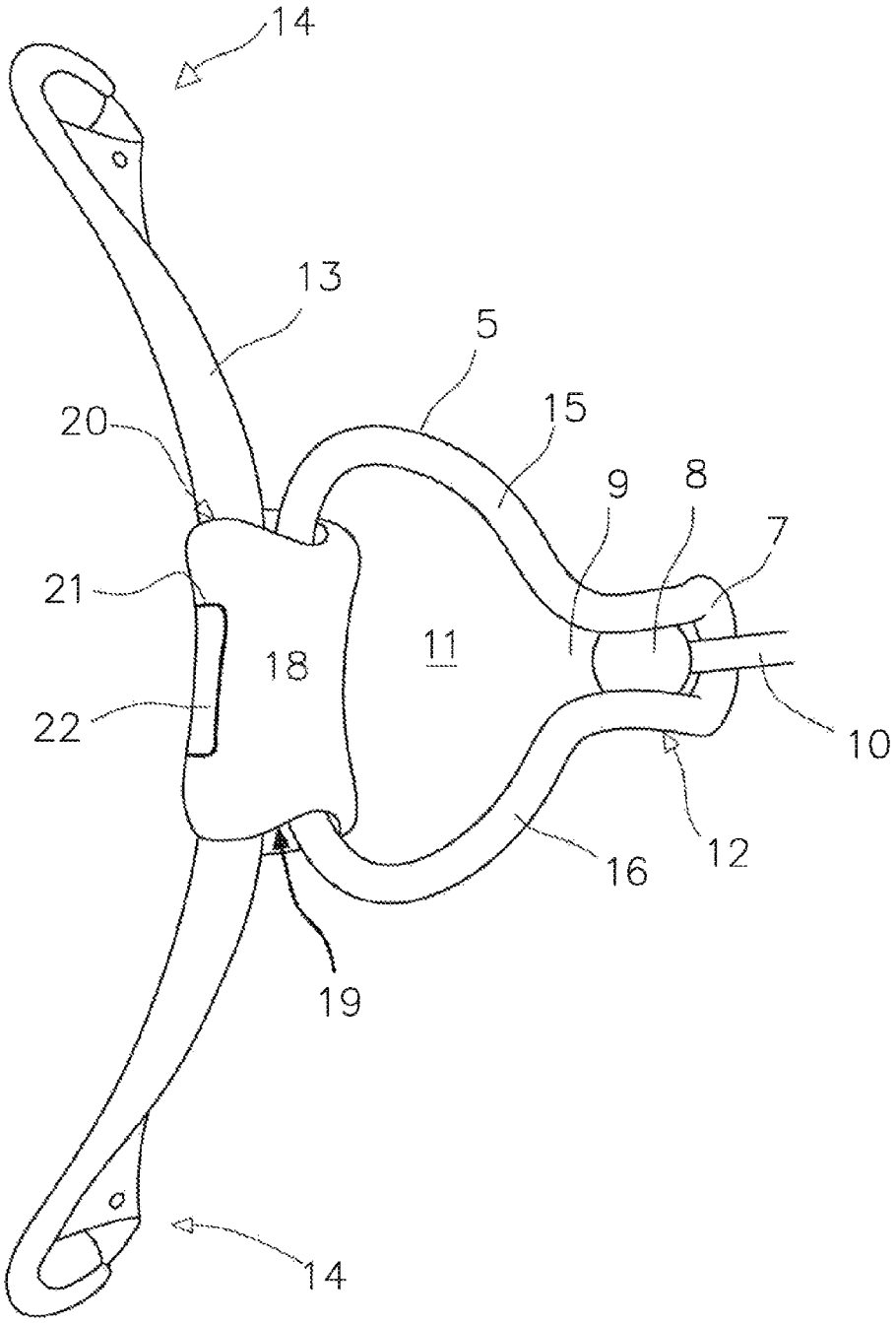
FIG. 8 illustrates the hookless coupling socket of FIGS. 5 through 7 in combination with a spreader bar.
Figure 9:
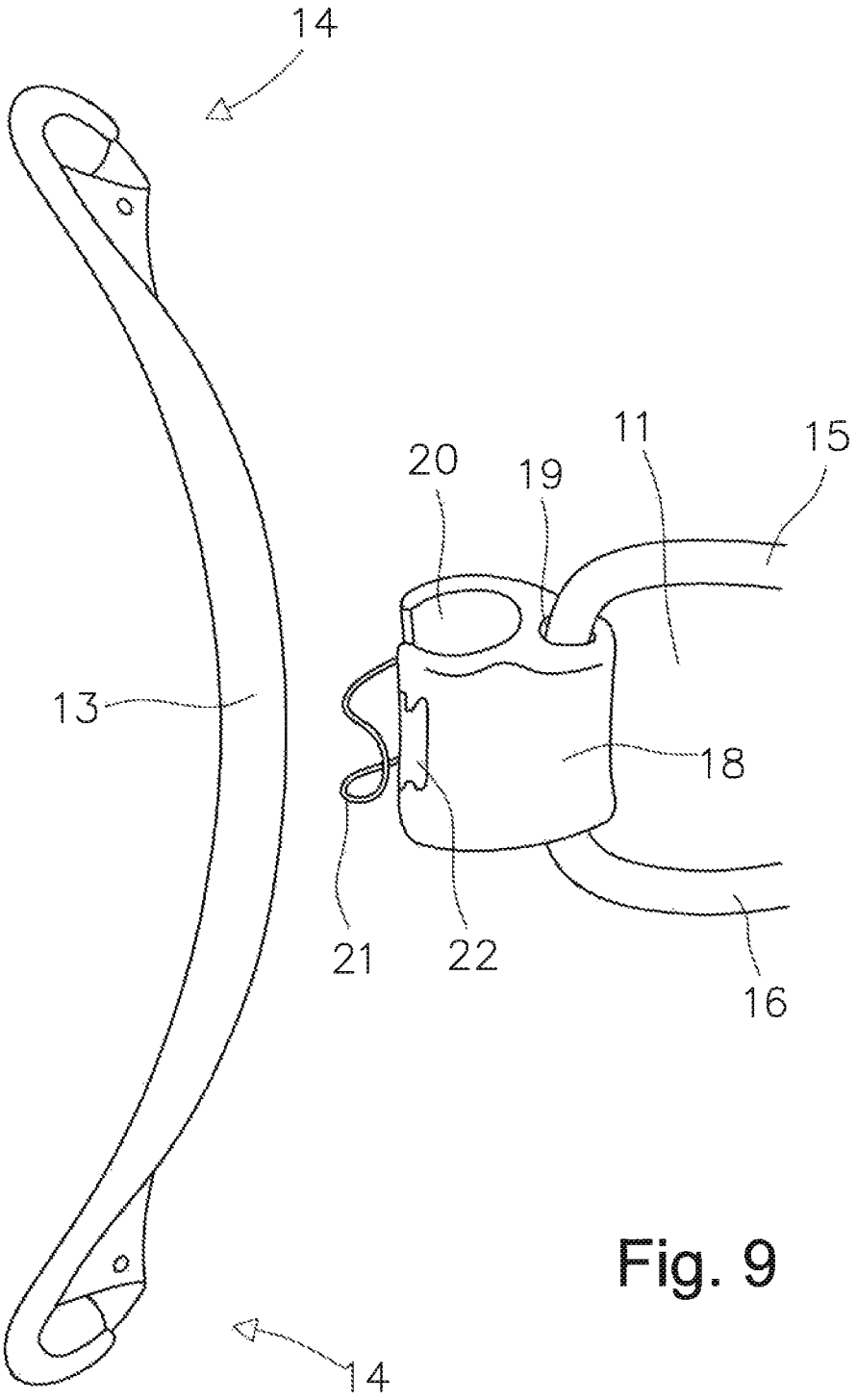
FIG. 9 illustrates a first connector for the hookless coupling socket and spreader bar of FIG. 8.
Figure 10:
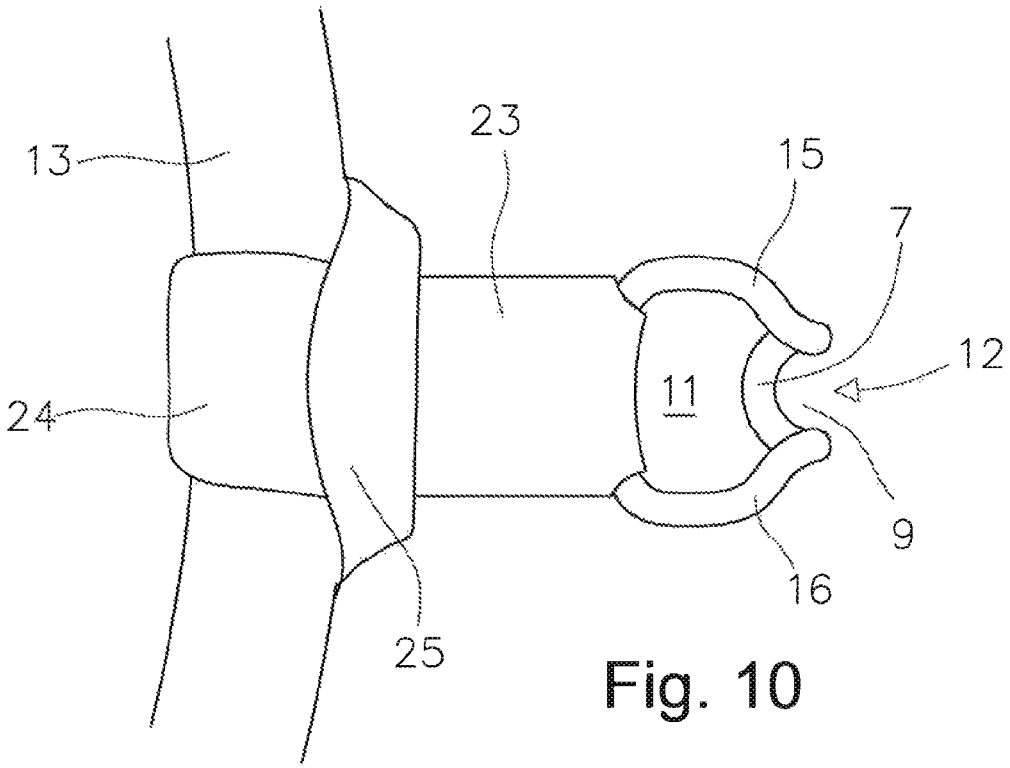
FIG. 10 is a bottom illustration of a second connector for a hookless coupling socket and spreader bar.
Figure 11:
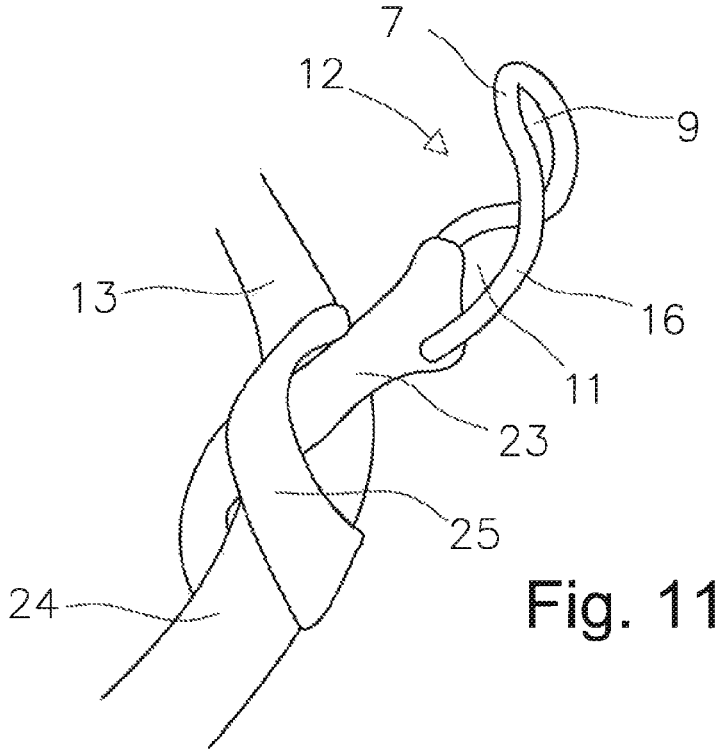
FIG. 11 is a perspective illustration of the second connector of FIG. 10.
Figure 12:
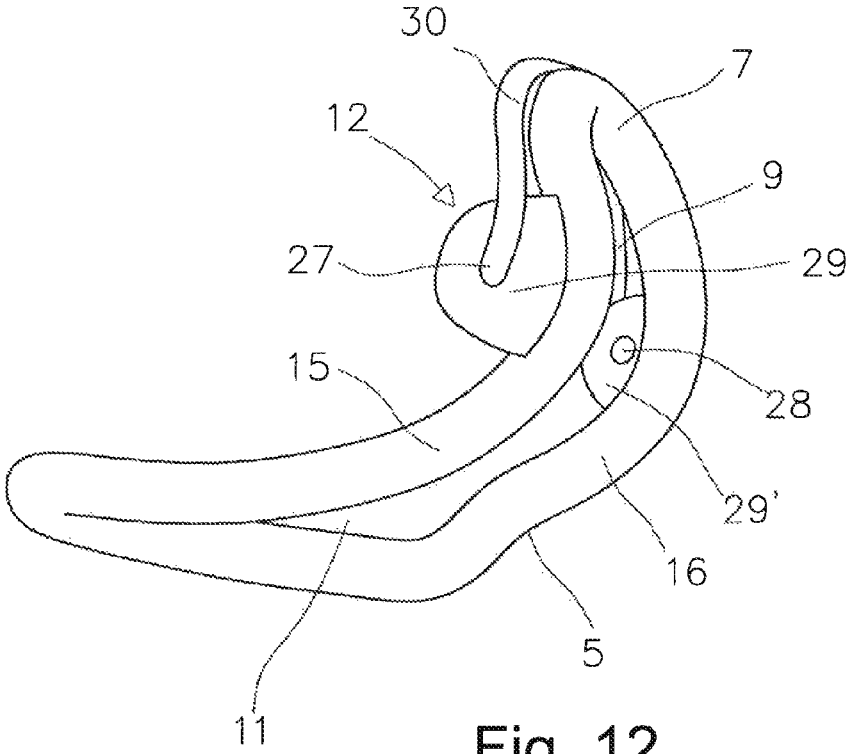
FIG. 12 is a perspective illustration of a second hookless coupling socket according to the invention, the second socket having a securing gate for the coupling ball.

FIGS. 5 through 7 show an alternative embodiment of the hookless coupling device 5 that may be connected directly to a sports harness 3 by a buckle or other means as aforementioned. In such an embodiment the device 5 has the same configuration as other embodiments from the engagement end 7 to the wider slot 11 at the connector end 6 for the engager 8 to pass through. In this embodiment the connector ends 6 of the body are closed by a transverse leg 17 that closes-the-loop on the elongate slot 9, 11. A strap and buckle or other such coupling means can engage with the transverse leg 17 to secure the hookless coupling device 5 directly to the harness without a spreader bar 13. Alternatively such a hookless coupling device 5 can also be removably connected with a spreader bar 13 in a flexible manner as illustrated in FIGS. 8 through 11. FIGS. 8 and 9 illustrate a plastic or elastic body 18 for connecting the hookless coupling device 5 with the spreader bar 13. The connecting body 18 has a first aperture 19 mounded for otherwise formed about the distal transverse leg 17 of the hookless coupling device 5. A second C-shaped aperture 20 is provide parallel to the first aperture 19 and has an open edge to allow the centre region on the spreader bar 13 to be introduced into the second aperture 20. A securing cord or spring clip 21 is provided and engageable with a catch 22 for closing the open edge of the second aperture 20 thereby flexibly and releasably connecting the hookless coupling device 5 to the spreader bar. As an alternative arrangement shown in FIGS. 10 and 11 a webbing strap is used to secure the hookless coupling device 5 to the spreader bar. A webbing loop is secured to or around the distal transverse leg 17 of the hookless coupling device 5 at its first end 23. The middle 24 of the loop is passed abound the central region of the spreader bar 13 and hookless coupling device 5 passed through the distal end 25 of the webbing loop to secure the loop and hookless coupling device 5 to the spreader bar in a flexible and releasable manner.

Figure 13:
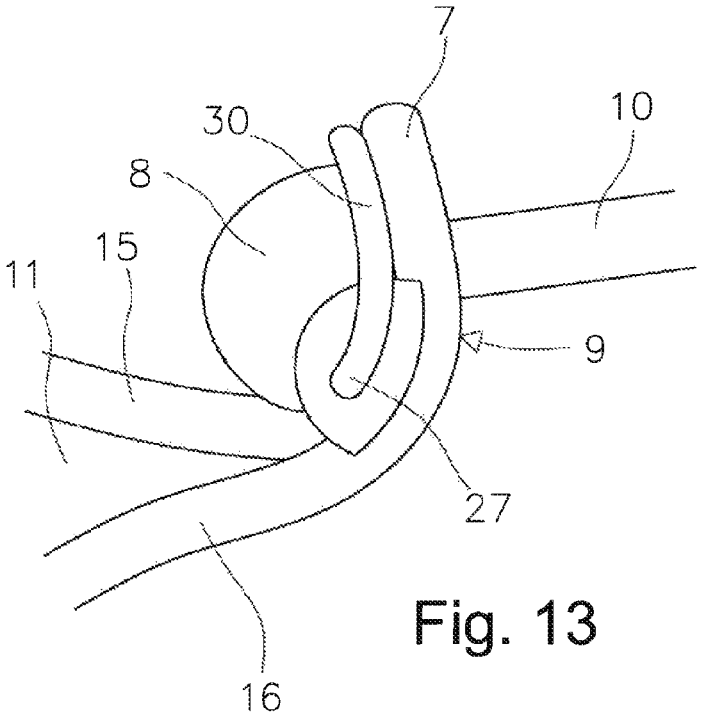
FIG. 13 illustrates the socket and gate of FIG. 12 with the gate in a non-securing position.
Figure 14:
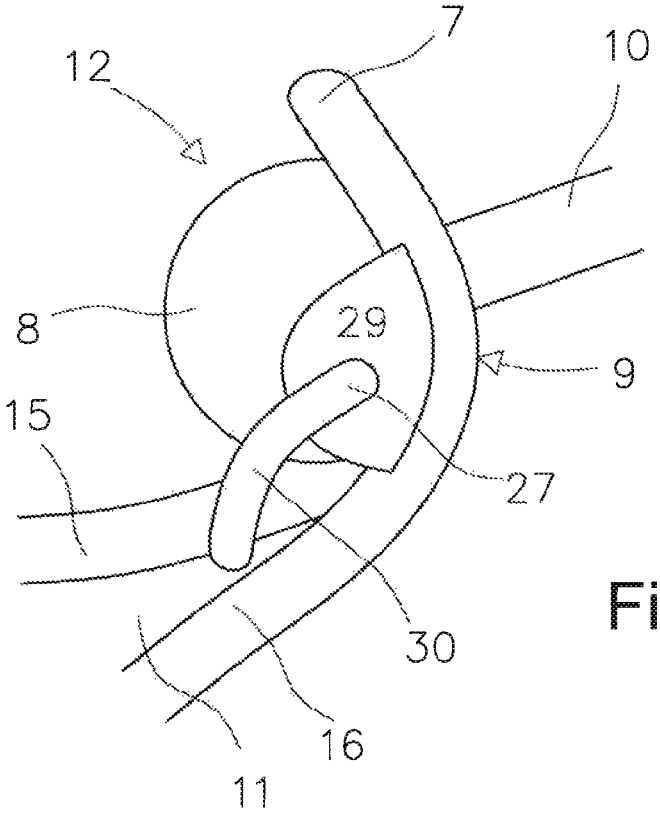
FIG. 14 illustrates the socket and gate of FIG. 12 with the gate in a securing position.
Figure 15:
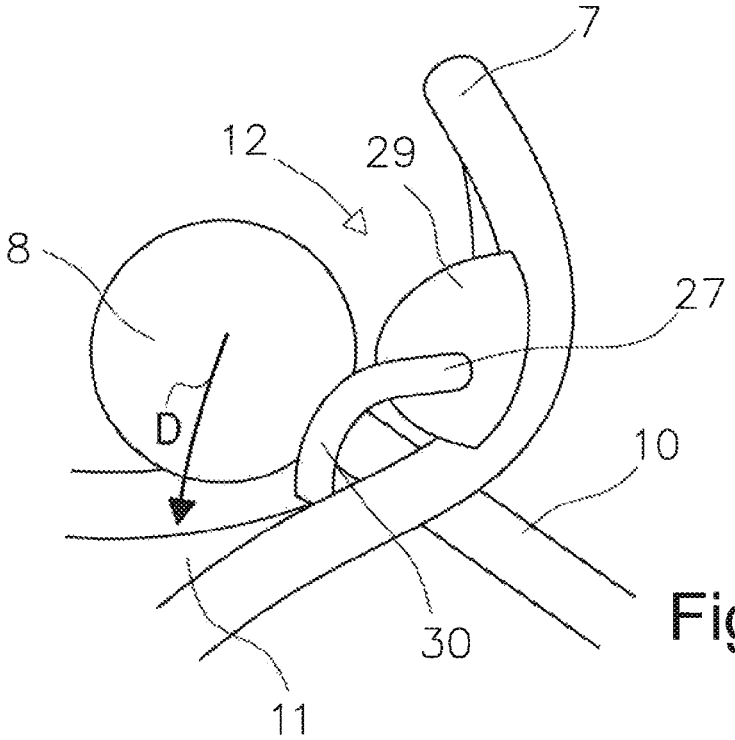
FIG. 15 illustrates how the ball is secured by the gate in the securing position.

In some situation, such as training for example, it is preferable to secure that ball engager 8 with the hookless coupling device 5 so that it cannot become uncoupled inadvertently. FIGS. 12 through 16 show an arrangement of the hookless coupling device 5 with a securing gate 30 that can be closed to secure the ball engager 8 with the hookless coupling device 5. In this embodiment a pair of tabs 29 are attached to respective side legs 15, 16 of the body 5 adjacent the narrower at the engagement end 7. A U-shaped gate 30 is pivotally secured to respective ones of the tabs 29 by its two open ends 27 28. The shape of the U-shaped gate 30 and position of the tabs 29 is such that the gate 30 follows closely the engagement end 7 of the body, and when moved to the secured position as discussed below, the gate can pass about the ball engager 8 and interfere with the wider end 11 of the slot. In a first, non-securing position, as shown in FIG. 13, the gate is positioned to lie against the engagement end 7 of the body 5. The ball engager 8 can be coupled with the hookless coupling device 5 as aforementioned. TO secure the ball engager with the hookless coupling device 5 the user manually flips, or pivots, the gate 30 to a second position, as shown in FIG. 14, such that the gate 30 passes around the ball engager 8 and interferes with the wider end 11 of the slot. FIG. 15 illustrates that with the gate 30 to a second securing position the ball cannot be moved in the downwardly direction of arrow D through the wider end 11 of the slot as required to uncouple the ball engager 8 and hookless coupling device 5. The gate 30 interferes with the ball 30 and line 10 preventing the ball 30 from passing though the wider end 11 of the slot. To uncouple the ball engager 8 and hookless coupling device 5 the rider must flip, or pivot, the gate 30 back to a first position, as shown in FIG. 13.

Although the preferred embodiment of the invention is a coupling device, the invention may be embodied as or sold coupled to or in conjunction with one or more of the engager, a spreader bar, a sports harness or a sports kite in part or complete. The preferred embodiment of the coupling device is described or illustrated for use in kite surfing. However, the skilled addressee with appreciate that the coupling device will find equal and equivalent application in other sports requiring a rider or user to be selectively coupled to sports equipment via a body harness. Such alternative examples include but are not limited to wind surfing and sailing trapeze.

The invention claimed is:

1. A sports kite and coupling device for coupling a sports harness to the sports kite, comprising:

a canopy;

a traction line having a first end tethered to the canopy and a second end;

a spherical engager connected to the second end of the traction line; and a hookless coupling device for coupling the sports harness to the second end of the traction line, wherein the hookless coupling device comprises an elongate body having a connector end for connection to the sports harness, an engagement end, and an elongate aperture extending between the connector end and the engagement end, wherein the aperture is wider at the connector end than at the engagement end, for receiving the spherical engager through the elongate aperture, and narrower at the engagement end than at the connector end, for engaging the spherical engager to the elongate body.

2. The sports kite and coupling device of claim 1 wherein the engagement end of the elongate aperture comprises a socket for pivotally engaging the spherical engager to the elongate body.

3. The sports kite and coupling device of claim 1 wherein the connector end includes an orthogonal spreader bar connectable between straps of the sports harness.

4. The sports kite and coupling device of claim 1 wherein the elongate body extends away from the connector end.

5. The sports kite and coupling device of claim 1 wherein the elongate body comprises:

a frame having two sides defining opposite elongate edges of the elongate aperture, and a curved end joining the two sides at the engagement end.

6. The sports kite and coupling device of claim 5 wherein the curved end defines a semi-circular socket for pivotally receiving the spherical engager.

7. The sports kite and coupling device of claim 1, wherein the spherical engager comprises a spherical body and an engager aperture securing the second end of the traction line to the spherical engager.

8. The sports kite and coupling device of claim 7 wherein the engager aperture is in the spherical body.

9. The sports kite and coupling device of claim 1, further comprising a band for surrounding a waist or hips of a person, wherein the hookless coupling device includes an elongate body, extending away from the band and including the elongate aperture.

* * * * *